US010116097B2

(12) United States Patent
Nakashima

(10) Patent No.: US 10,116,097 B2
(45) Date of Patent: Oct. 30, 2018

(54) SHIELD TERMINAL AND OUTER CONDUCTOR TERMINAL

(71) Applicant: Sumitomo Wiring Systems, Ltd., Yokkaichi, Mie (JP)

(72) Inventor: Keita Nakashima, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 15/786,808

(22) Filed: Oct. 18, 2017

(65) Prior Publication Data

US 2018/0115115 A1 Apr. 26, 2018

(30) Foreign Application Priority Data

Oct. 21, 2016 (JP) ..... 2016-206655

(51) Int. Cl.

| | |
|---|---|
| ***H01R 11/20*** | (2006.01) |
| ***H01R 13/6581*** | (2011.01) |
| ***H01R 4/18*** | (2006.01) |
| ***H01R 9/05*** | (2006.01) |
| ***H01R 13/436*** | (2006.01) |
| ***H01R 13/642*** | (2006.01) |
| ***H01R 24/44*** | (2011.01) |
| *H01R 103/00* | (2006.01) |

(52) U.S. Cl.

CPC ..... *H01R 13/6581* (2013.01); *H01R 4/184* (2013.01); *H01R 4/185* (2013.01); *H01R 4/188* (2013.01); *H01R 9/0518* (2013.01); *H01R 13/4364* (2013.01); *H01R 13/642* (2013.01); *H01R 24/44* (2013.01); *H01R 2103/00* (2013.01)

(58) Field of Classification Search

CPC .... H01R 9/053; H01R 103/00; H01R 13/501; H01R 13/052

USPC ..... 439/394, 731, 467, 825

See application file for complete search history.

(56) References Cited

U.S. PATENT DOCUMENTS 5,123,864 A * 6/1992 Karlovich ..... H01R 4/184 439/585
5,730,622 A * 3/1998 Olson ..... H01R 13/6474 439/575
6,015,315 A * 1/2000 Ensign ..... H01R 24/44 439/578

FOREIGN PATENT DOCUMENTS

JP 2009-187826 8/2009

* cited by examiner

*Primary Examiner* — Phuong Chi T Nguyen
(74) *Attorney, Agent, or Firm* — Gerald E. Hespos; Michael J. Porco; Matthew T. Hespos

(57) ABSTRACT

A shield terminal (10) includes an inner conductor terminal (11), dielectrics (12, 13) configured to accommodate the inner conductor terminal (11), an outer conductor terminal (20) configured to surround the dielectrics (12, 13), a tubular fitting (30) formed in a front end part of the outer conductor terminal (20) in an axial direction, and resilient contacts (31) formed in the tubular fitting (30) and having both front and rear ends integrally connected to the tubular fitting (30). The tubular fitting (30) has interlocking regions (39) surrounding only front end parts (31F) of the resilient contacts (31) and connected to front ends of the resilient contacts (31) are radially resiliently deflectable with front end sides thereof as free ends.

4 Claims, 9 Drawing Sheets

SHIELD TERMINAL AND OUTER CONDUCTOR TERMINAL

BACKGROUND

Field of the Invention

The invention relates to a shield terminal and an outer conductor terminal.

Description of the Related Art

Japanese Unexamined Patent Publication No. 2009-187826 discloses a shield terminal with an inner conductor terminal to be fixed to a signal conductor of a shielded cable and an outer conductor terminal to be fixed to a shield conductor of the shielded cable. The outer conductor terminal has a fitting tube to be fit to an outer conductor terminal of a mating shield terminal. The fitting tube is formed with a resilient contact piece by cutting and raising a part of the fitting tube toward an inner peripheral side, and this resilient contact piece resiliently contacts the outer periphery of the mating outer conductor terminal.

The resilient contact piece of the fitting tube is cantilevered toward the mating outer conductor. Thought has been given to connecting both axial ends of the resilient contact piece to the fitting tube in an effort to enhance contact pressure of the resilient contact piece. However, the contact pressure of a resilient contact piece that has both ends connected to the fitting tube is excessively high as compared to the resilient contact piece supported on only one end. The contact pressure of the resilient contact piece supported on both ends could be reduced by thinning, narrowing or lengthening the resilient contact piece. However, a thinning or narrowing the resilient contact piece is difficult and costly to manufacture. Further, a longer resilient contact piece enlarges the outer conductor terminal in the axial direction.

The invention was completed based on the above situation and aims to suppress a contact pressure of a resilient contact portion without changing the shape, dimension or the like of the resilient contact portion when the resilient contact portion of an outer conductor terminal is supported on both ends.

SUMMARY

The invention is directed to a shield terminal with an inner conductor terminal, a dielectric configured to accommodate the inner conductor terminal, an outer conductor terminal configured to surround the dielectric, a tubular fitting formed in a front part of the outer conductor terminal in an axial direction, and a resilient contact formed in the tubular fitting. The resilient contact has both front and rear ends in the axial direction of the outer conductor terminal integrally connected to the tubular fitting. An interlocking region surrounds only a front end part of the resilient contact and is connected to a front end of the resilient contact. The interlocking region is radially resiliently deflectable and has a free front end.

The invention also is directed to an outer conductor terminal of a shield terminal. The outer conductor terminal surrounds a dielectric that has an inner conductor terminal accommodated inside. A front part of the outer conductor terminal has a tubular fitting formed with a resilient contact that has front and rear ends in the axial direction of the outer conductor terminal integrally connected to the tubular fitting. The front end of the tubular fitting has an interlocking region connected to a front end of the resilient contact portion and to areas of the tubular fitting offset circumferentially from the resilient contact in each circumferential direction so that the interlocking region is radially resiliently deformable with a front end thereof defining a free end.

The interlocking region of the tubular fitting is connected to the front end of the resilient contact and resiliently deforms radially with the resilient contact when the resilient contact portion is deformed resiliently by being pressed radially. A stress generated in the resilient contact portion is alleviated by the resilient deformation of the interlocking region. Thus, a contact pressure of the resilient contact portion can be reduced without changing the shape, dimension or the like of the resilient contact portion.

The tubular fitting may be formed with a non-interlocking region. The non-interlocking region is offset from the resilient contact portion in a circumferential direction and is separated from the interlocking region in the circumferential direction by a slit. According to this configuration, when an external matter interferes with the tubular fitting from the front, an impact of interference is distributed to both the interlocking region and the non-interlocking region. Thus, improper deformation of the interlocking region can be avoided.

The resilient contact may include a contact configured to contact an outer periphery of a mating outer conductor when the tubular fitting is fit properly to the mating outer conductor. A front inclined portion may incline radially out toward the front from the contact and may be configured so that a leading end part of the mating outer conductor slides in contact therewith. A rear inclined portion may incline radially out toward the rear from the contact and may have a larger angle of inclination with respect to a fitting direction to the mating outer conductor than the front inclined portion. According to this configuration, when the leading end of the mating outer conductor slides in contact with the front inclined portion and the resilient contact is pressed rearward, an area of the resilient contact where the front inclined portion and the rear inclined portion are formed resiliently deforms radially inward with the rear end of the rear inclined portion as a support. When the interlocking region is displaced resiliently radially inward according to this resilient deformation of the resilient contact, a width of the slit between the interlocking region and the non-interlocking region narrows. Thus, a reduction in shielding function due to the presence of the slit can be suppressed.

A rear end of the slit may be located before a rear end of the rear inclined portion. According to this configuration, a radially inward resilient displacement amount of the interlocking region is larger as compared to the case where the rear end of the slit is located behind the rear end of the rear inclined portion.

DETAILED DESCRIPTION

One specific embodiment of the present invention is described with reference to FIGS. 1 to 12. Note that, in the following description, an oblique left-lower side in FIG. 1 and a left side in FIGS. 2, 3 and 5 to 12 are defined as a front side concerning a front-rear direction. Upper and lower sides shown in FIGS. 1, 2, 4 and 5 are directly defined as upper and lower sides concerning a vertical direction.

A shielded cable (not shown) as a connection target of a shield terminal 10 is formed such that an inner conductor having an axial direction extending in the front-rear direction is surrounded by a hollow cylindrical insulating layer, the outer periphery of the insulating layer is surrounded by a shield conductor formed of a braided wire and the shield connector is surrounded by an insulating sheath. A rear end part of the shield terminal 10 is conductively connected to a front end part of the shielded cable.

Figure 1:
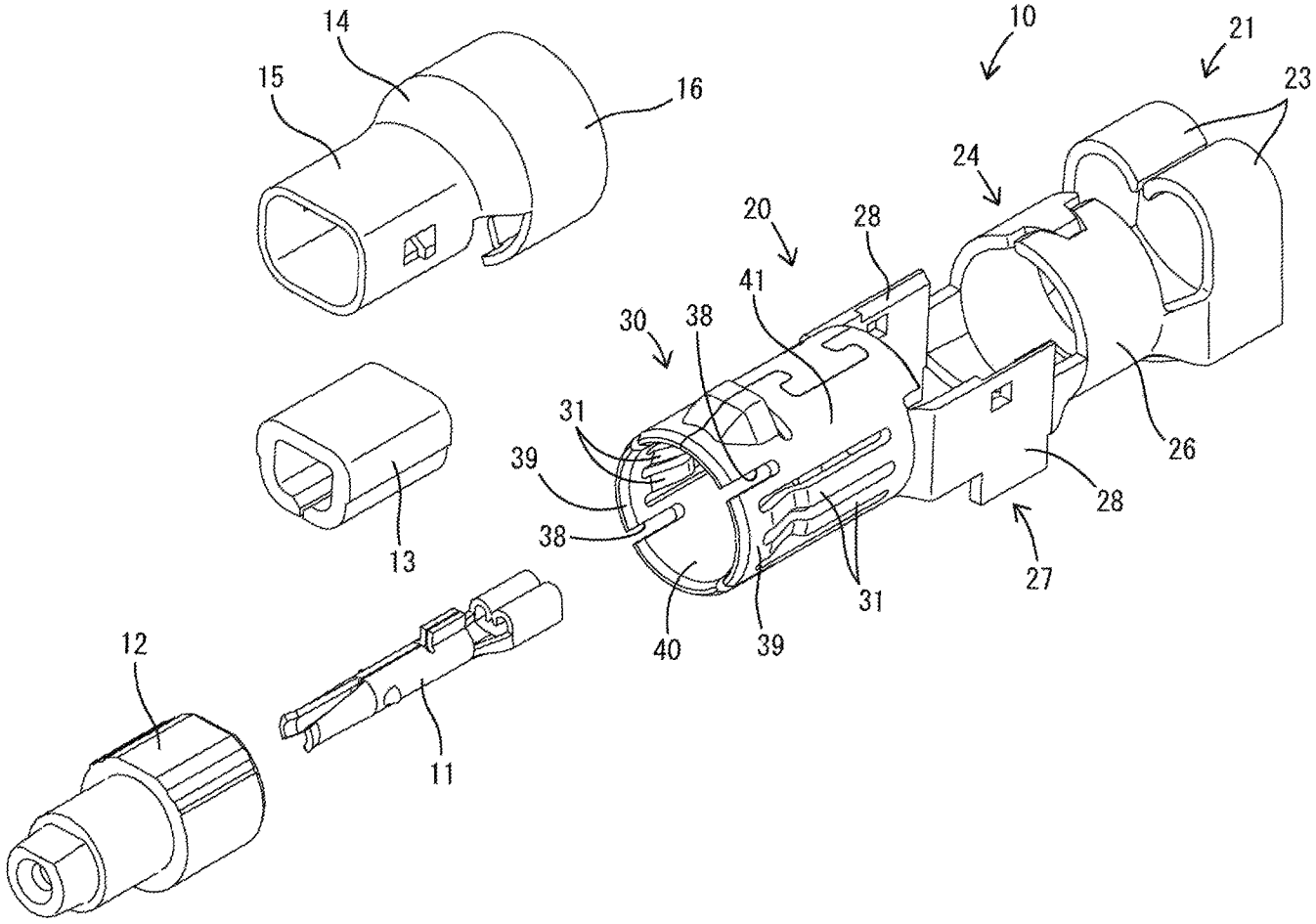
FIG. 1 is an exploded perspective view of a shield terminal of one embodiment.
Figure 2:
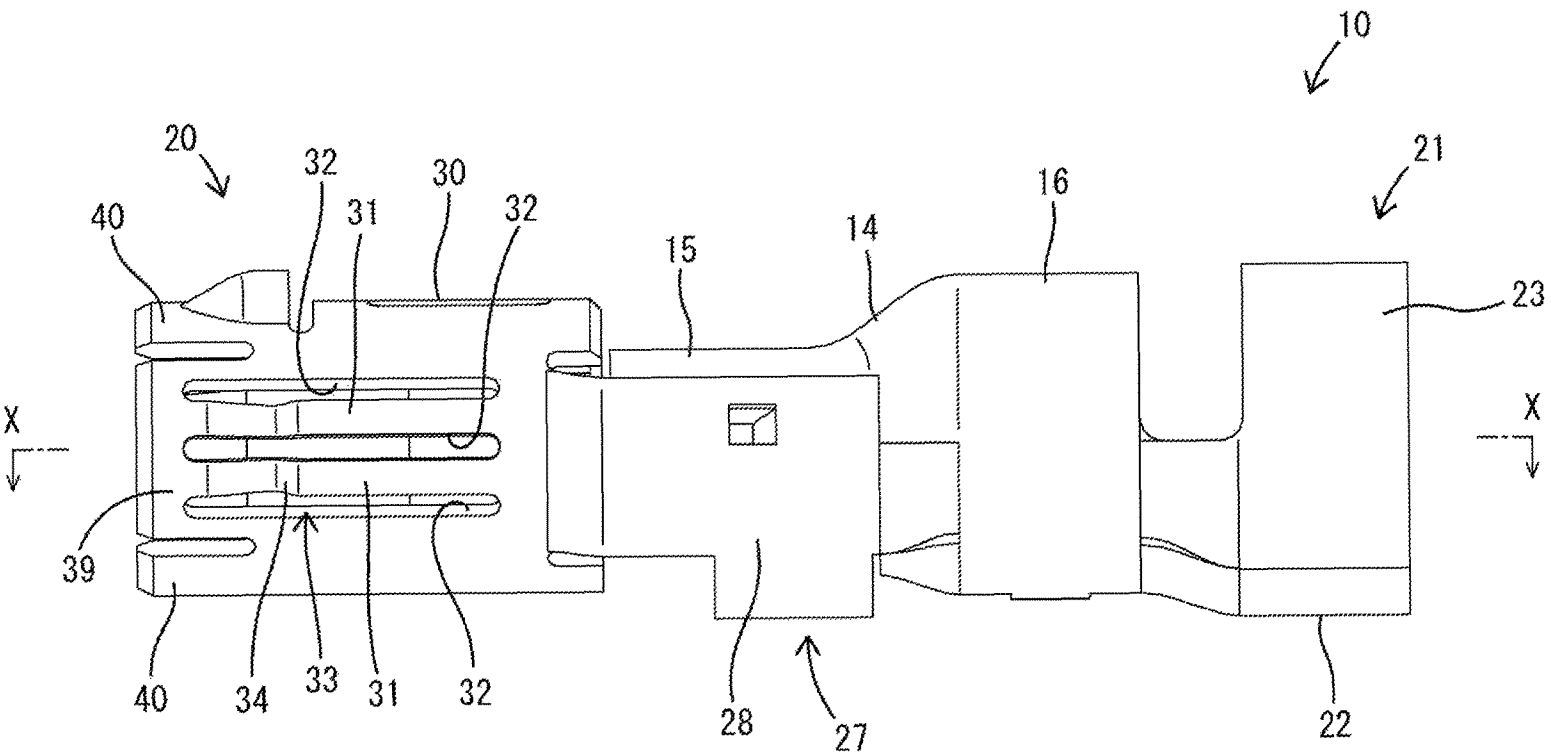
FIG. 2 is a side view of the shield terminal.
Figure 3:
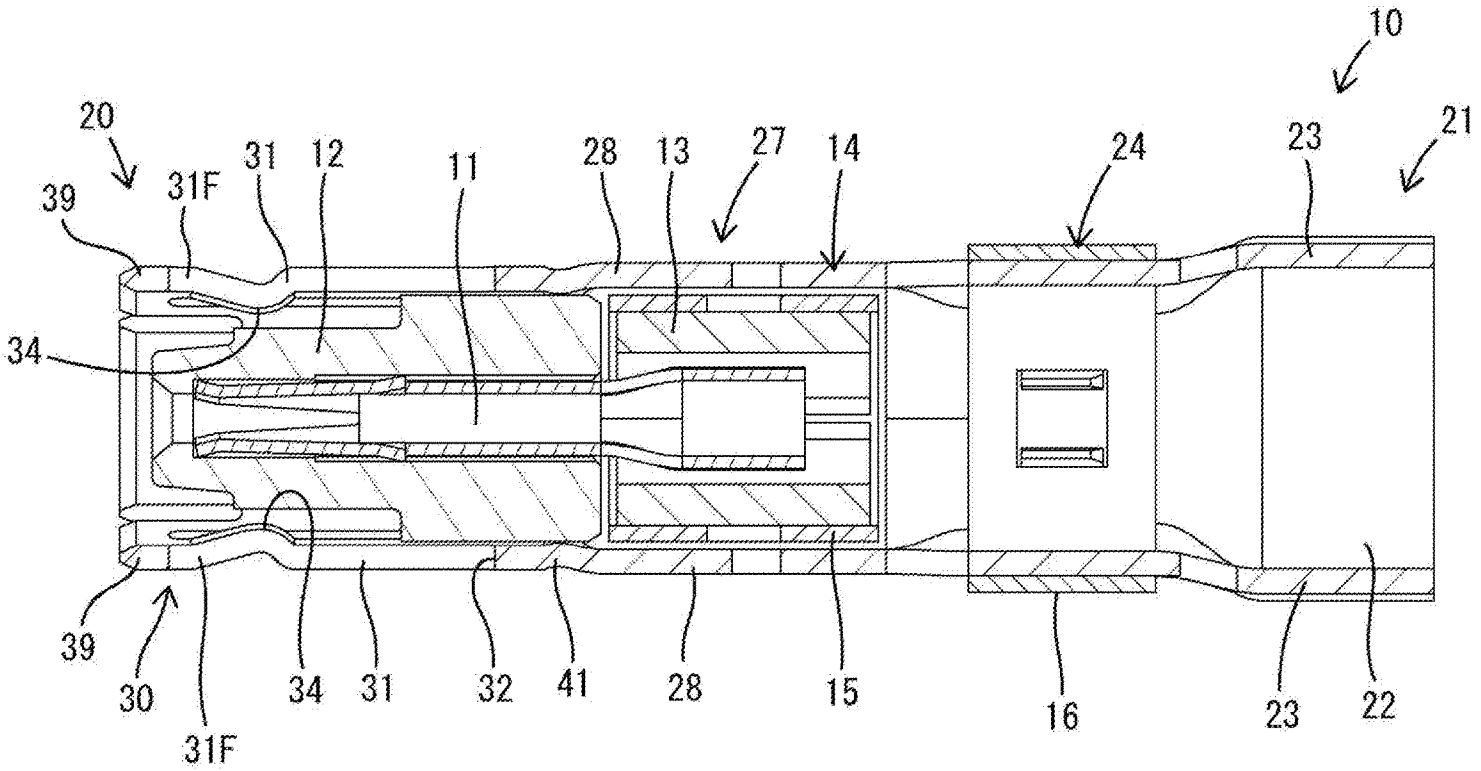
FIG. 3 is a section along X-X of FIG. 2.
Figure 4:
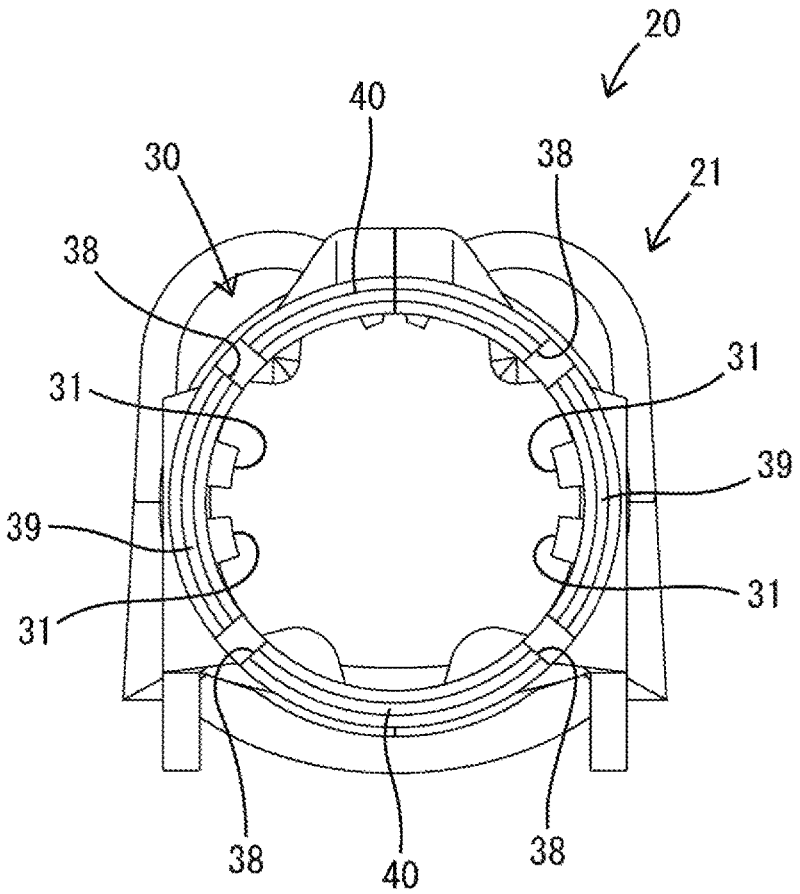
FIG. 4 is a front view of an outer conductor terminal.
Figure 5:
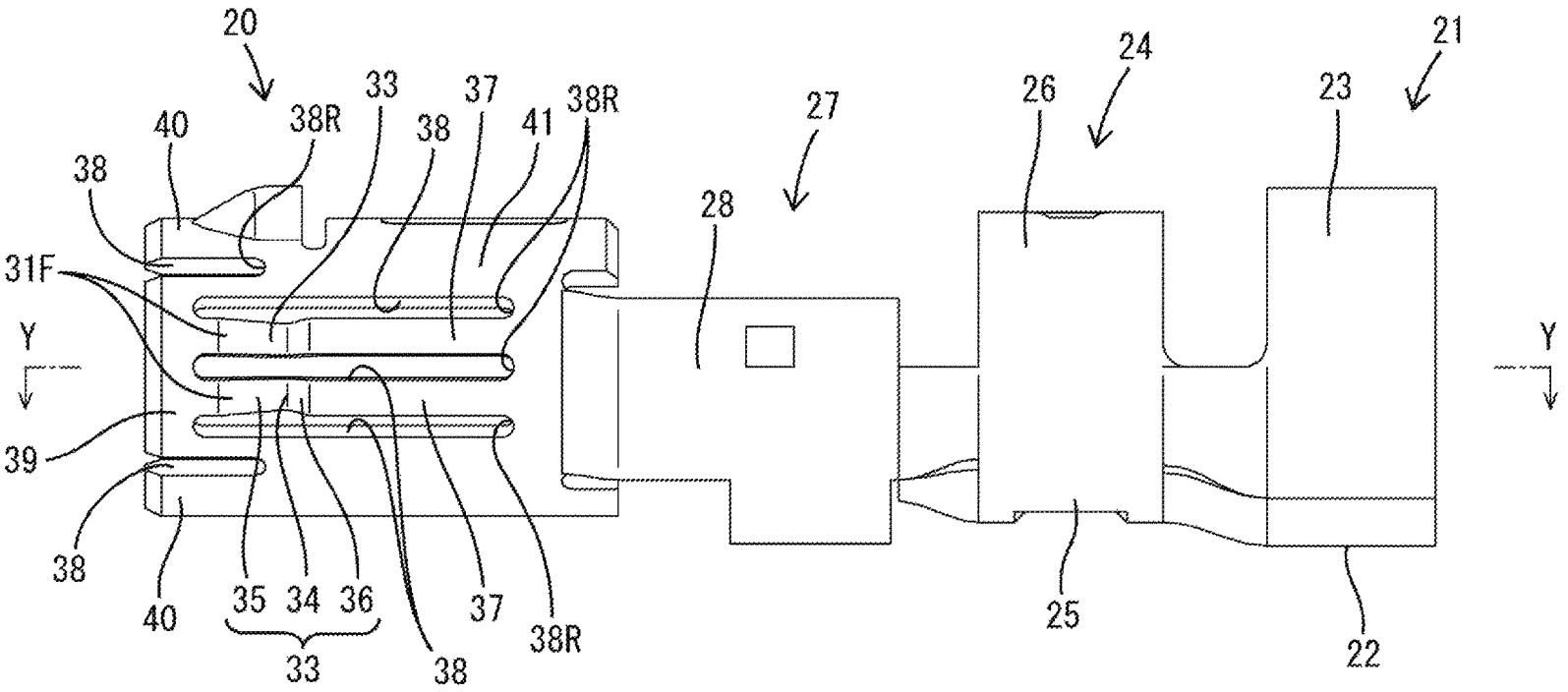
FIG. 5 is a side view of the outer conductor terminal.
Figure 6:
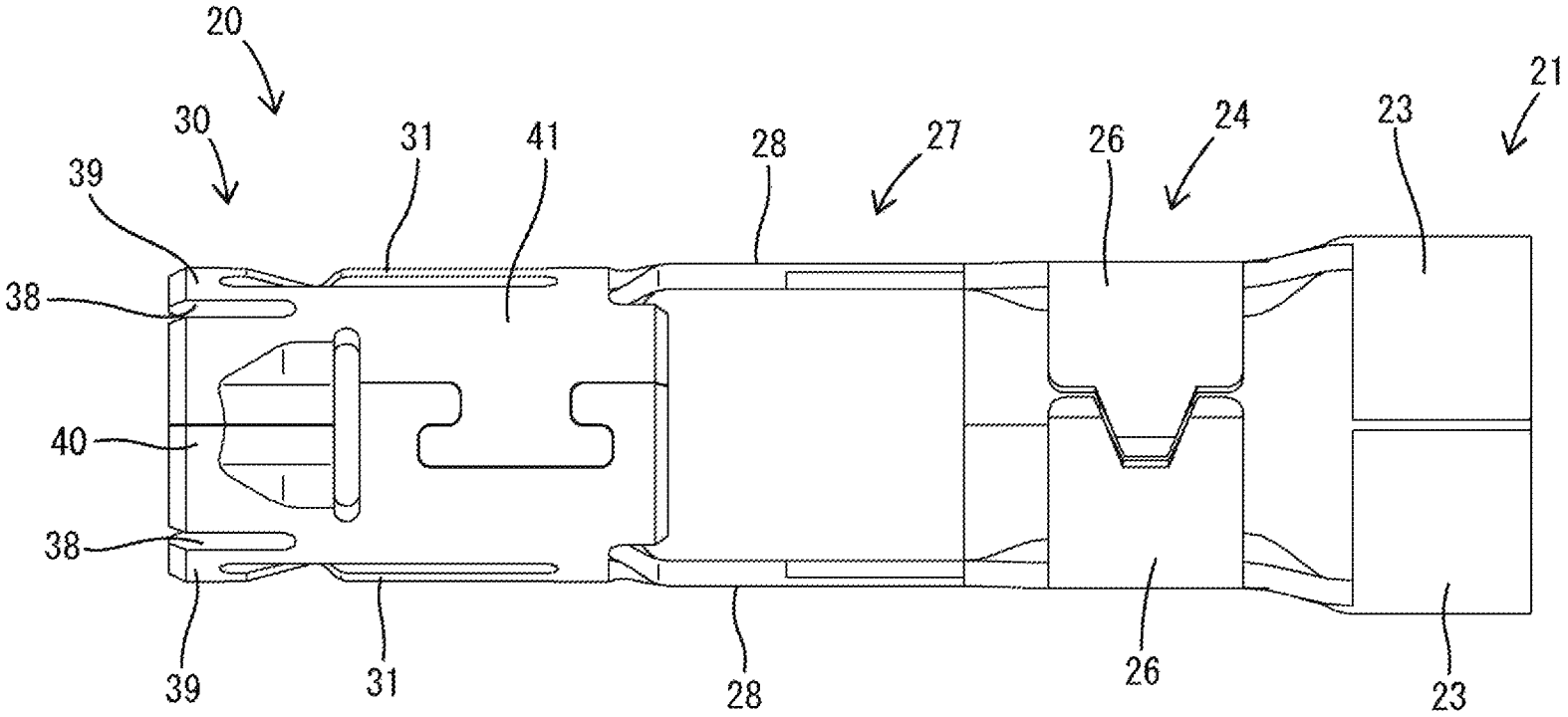
FIG. 6 is a plan view of the outer conductor terminal.

As shown in FIGS. 1 and 3, the shield terminal 10 includes an inner conductor terminal 11 substantially in the form of a tube long and narrow in the front-rear direction, a first dielectric 12 and a second dielectric 13 made of synthetic resin for accommodating the inner conductor terminal 11, an outer conductor terminal 20 for surrounding the dielectrics and a shield member 14 to be mounted on the outer conductor terminal 20. The inner conductor terminal 11 is conductively fixed to an inner conductor of the shielded cable.

The outer conductor terminal 20 is a single component made of metal and including a first crimping portion 21, a second crimping portion 24, a linking portion 27 and a tubular fitting portion 30. The first crimping portion 21 is disposed on a rear end part of the outer conductor terminal 20 and in the form of an open barrel having a pair of first caulking pieces 23 extending from both left and right sides of a first base plate portion 22. The first crimping portion 21 is fixed to the outer periphery of the sheath of the shielded cable. The second crimping portion 24 is connected to a front end part of the first crimping portion 21 and in the form of an open barrel having a pair of second caulking pieces 26 extending from both left and right sides of a second base plate portion 25. The second crimping portion 24 is fixed to the shield conductor of the shielded cable. The linking portion 27 includes a pair of left and right side plates 28. Rear end parts of the pair of side plates 28 are connected to the front end edges of the pair of caulking pieces 26, and front end parts of the pair of side plates 28 are linked to both left and right side edge parts in the rear end part of the tubular fitting portion 30.

The tubular fitting portion 30 has a hollow cylindrical shape having an axial direction extending in the front-rear direction as a whole and is disposed on a front end part of the outer conductor terminal 20. The first dielectric 12 has a tubular shape and is mounted in the outer conductor terminal 20 while being accommodated in the tubular fitting portion 30. The shield member 14 is a single component made of metal and formed by connecting a cover portion 16 on the rear end of a tubular portion 15. The tubular second dielectric 13 is accommodated in a tubular member. The shield member 14 is conductively mounted on the outer conductor terminal 20 with the tubular portion 15 accommodated in the linking portion 27 and the cover portion 16 externally fit on the second crimping portion 14. By mounting the shield member 14, upper and lower openings of the linking portion 27 are closed to improve a shielding function of the outer conductor terminal 20. The inner conductor terminal 11 is accommodated inside the first and second dielectrics 12, 13.

A hollow cylindrical mating outer conductor 42 is fit into the tubular fitting portion 30 from front. In a fit state, the mating outer conductor 42 is fit into a clearance between the outer periphery of the first dielectric 12 and the inner periphery of the tubular fitting portion 30. The tubular fitting portion 30 is integrally formed with two pairs of resilient contact portions 31 capable of resiliently contacting the outer periphery of the mating outer conductor 42. The resilient contact portions 31 resiliently contact the outer periphery of the mating outer conductor 42, whereby the outer conductor terminal 20 and the mating outer conductor 42 are conductively connected with a predetermined contact pressure.

The two pairs of resilient contact portions 31 are bilaterally symmetrically disposed on both left and right side surface parts of the tubular fitting portion 30. Two resilient contact portions 31 paired on a left side of the tubular fitting portion 30 are respectively formed to extend long and narrow in the front-rear direction (direction parallel to a fitting direction of the outer conductor 20 and the mating outer conductor 42) and arranged side by side in a circumferential direction (vertical direction). Two resilient contact portions 31 paired on a right side of the tubular fitting portion 30 are also respectively formed to extend long and narrow in the front-rear direction (direction parallel to the fitting direction of the outer conductor 20 and the mating outer conductor 42) and arranged side by side in the circumferential direction (vertical direction).

Each resilient contact portion 31 is formed by forming cut portions 32 long and narrow in the front-rear direction in the tubular fitting portion 30. Specifically, areas between three juxtaposed cut portions 32 of the tubular fitting portion 30 serve as the paired two resilient contact portions 31. Each resilient contact portion 31 is supported on both ends by having the front and rear ends thereof directly linked to the tubular fitting portion 30 and resiliently displaceable toward radially outer and inner sides.

Figure 7:
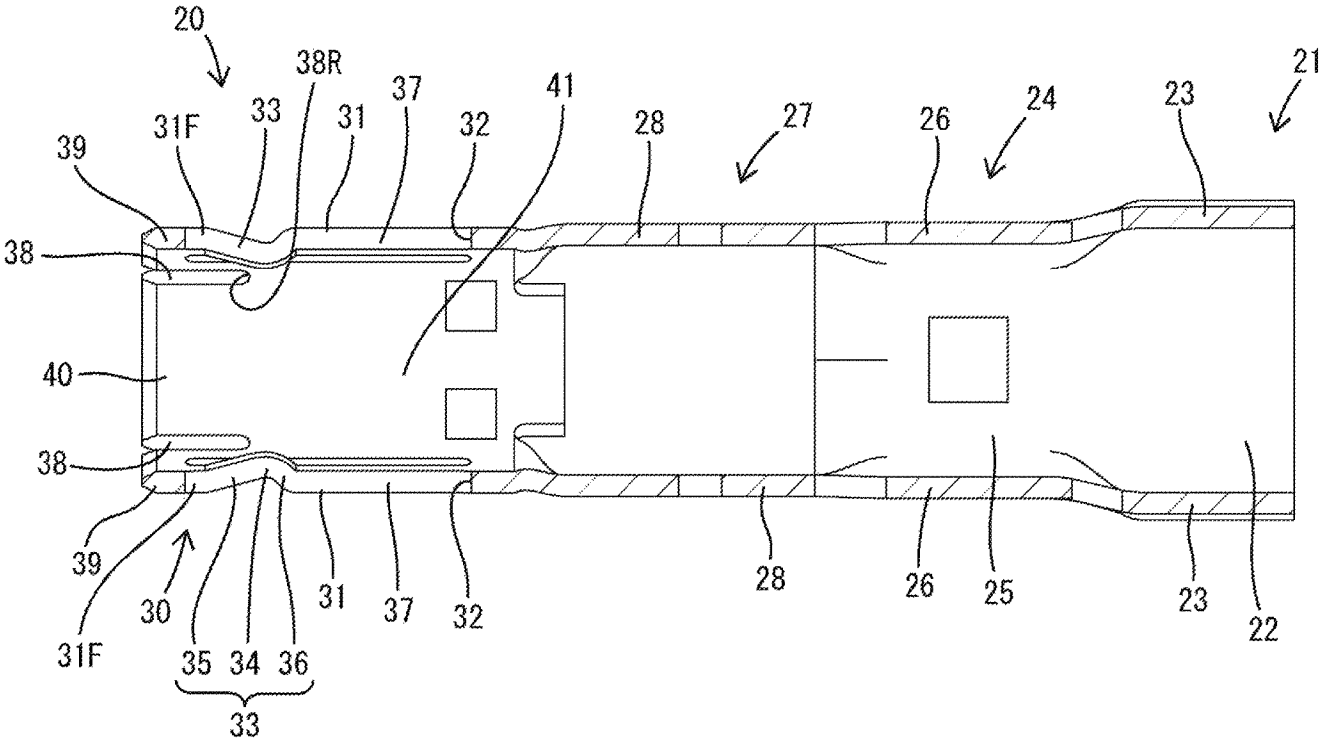
FIG. 7 is a section along Y-Y of FIG. 5.

The resilient contact portion 31 is composed of a bent region 33 and a straight region 37. The bent region 33 constitutes a front end part of the resilient contact portion 31 and the straight region 37 constitutes a part of the resilient contact portion 31 behind the bent region 33. A dimension of the bent region 33 in the front-rear direction is shorter than that of the straight region 37 in the front-rear direction. Thus, the rear end of the bent region 33 is located before a center of the resilient contact portion 31 in the front-rear direction (length direction). As shown in FIGS. 3 and 7, the bent region 33 projects more radially inward than the inner peripheral surface of the tubular fitting portion 30 and the straight region 37 extends straight in the front-rear direction when the resilient contact portion 31 is in a free state without being resiliently deformed.

A most radially inwardly projecting part of the bent region 33 serves as a contact point portion 34 configured to come into contact with the outer periphery of the mating outer conductor 42 when the tubular fitting portion 30 is properly fit to the mating outer conductor 42. The contact point portion 34 is located before the center of the resilient contact portion 31 in the front-rear direction (length direction of the resilient contact portion 31) and behind a center of the bent region 33 in the front-rear direction.

An area of the bent region 33 between the front end of the resilient contact portion 31 (bent region 33) and the contact point portion 34 serves as a front inclined portion 35 inclined radially outwardly toward the front end of the resilient contact portion 31 from the contact point portion 34. In the process of fitting the outer conductor terminal 20 and the mating outer conductor 42, a leading end edge of the mating outer conductor 42 slides in contact with the inner surface of the front inclined portion 35. By this sliding contact, a rearward pressing force and a radially outward pressing force act on the bent region 33.

An area of the bent region 33 between the contact point portion 34 and the rear end of the bent region 33 (front end of the straight region 37) serves as a rear inclined portion 36 inclined radially outwardly toward the rear end of the bent region 33 from the contact point portion 34. An angle of inclination of the rear inclined portion 36 with respect to the front-rear direction is larger than that of the front inclined portion 35 with respect to the front-rear direction. A dimension of the rear inclined portion 36 in the front-rear direction is smaller than that of the front inclined portion 35 in the front-rear direction.

The tubular fitting portion 30 is formed with two pairs of left and right slits 38 extending rearward from the front end edge thereof. The slits 38 paired on the left side of the tubular fitting portion 30 are positioned at both sides of the paired resilient contact portions 31 in the circumferential direction (vertical direction). The slits 38 paired on the right side of the tubular fitting portion 30 are also positioned at both sides of the paired resilient contact portions 31 in the circumferential direction (vertical direction). The front end part of the tubular fitting portion 30 is divided into four regions, i.e. a pair of bilaterally symmetrical and arcuate interlocking regions 39 and a pair of upper and lower arcuate non-interlocking regions 40 by the two pairs of slits 38.

Each interlocking region 39 is disposed to surround only front end parts 31F of the pair of resilient contact portions 31 from front and in the circumferential direction (vertical direction). Only the front end of the resilient contact portion 31, out of both front and rear ends, is connected to the interlocking region 39. Further, the rear end of the interlocking region 39 (rear end 38R of the slit 38) is disposed at a position corresponding to the bent regions 33 in the front-rear direction. Specifically, the rear end of the interlocking region 39 is disposed at a positon corresponding to the front inclined portion 35, in other words, at a position slightly before the contact point portion 34. As just described, only an area of the front inclined portion 35 excluding a rear end part is included in the front end part 31F of the resilient contact portion 31 surrounded by the interlocking region 39. Note that the resilient contact portions 31 are not included in the interlocking region 39.

The interlocking region 39 is a part constituting the front end part of the tubular fitting portion 30 and cantilevered forward. The front ends of the resilient contact portions 31 are connected to the interlocking region 39. Thus, when the resilient contact portions 31, particularly the bent regions 33, are resiliently deformed in a radial or axial direction by receiving an external force in the radial direction or axial direction (front-rear direction), the interlocking region 39 is resiliently displaceable in the radial direction with the rear end thereof as a supporting point in conjunction with the resilient deformation.

An area of the tubular fitting portion 30 behind the interlocking regions 39 and the non-interlocking regions 40 serves as a tubular body portion 41. Since the tubular body portion 41 has a hollow cylindrical shape continuous over the entire circumference, even if the interlocking regions 39 are resiliently deformed in the radial direction, the tubular body portion 41 is hardly resiliently deformed. The rear ends of the resilient contact portions 31 are linked to this tubular body portion 41. Further, since the non-interlocking regions 40 are not directly linked to the resilient contact portions 31, the non-interlocking regions 40 are hardly resiliently deformed even if the interlocking regions 39 are resiliently deformed.

Figure 8:
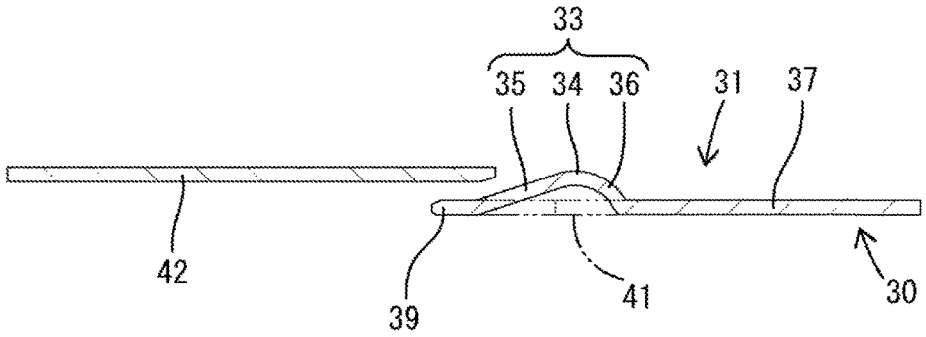
FIG. 8 is a partial enlarged section schematically showing a state where the fitting of a tubular fitting portion and a mating outer conductor is started.
Figure 9:
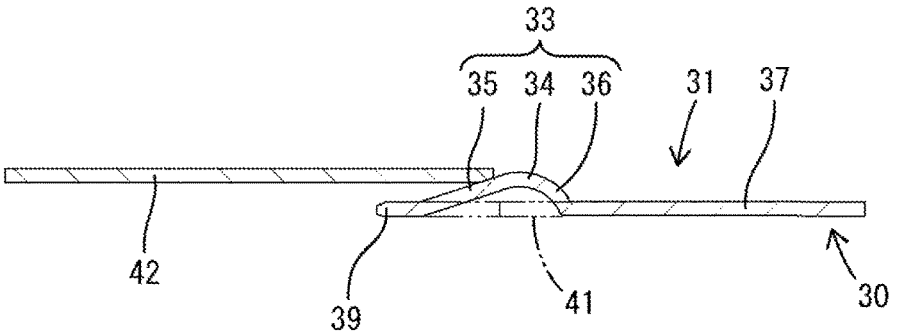
FIG. 9 is a partial enlarged section schematically showing a state where a leading end edge of a mating outer conductor is in contact with a resilient contact piece in the process of fitting the tubular fitting portion and the mating outer conductor.

Next, functions of this embodiment are described. When the fitting of the tubular fitting portion 30 (outer conductor terminal 20) and the mating outer conductor 42 is started as shown in FIG. 8, the leading end edge of the mating outer conductor 42 comes into contact with the inner surfaces of the front inclined portions 35 as shown in FIG. 9. When the fitting operation progresses from this state and the leading end edge of the mating outer conductor 42 slides in contact with the inner surfaces of the front inclined portions 35 as shown in FIG. 10, the bent regions 33 receive a pressing force in the axial direction from front and, at the same time, receives a radially outward (downward in FIGS. 8 to 12) pressing force due to frictional resistance between the front inclined portions 35 and the mating outer conductor 42 and the inclination of the inner surfaces of the front inclined portions 35.

Figure 10:
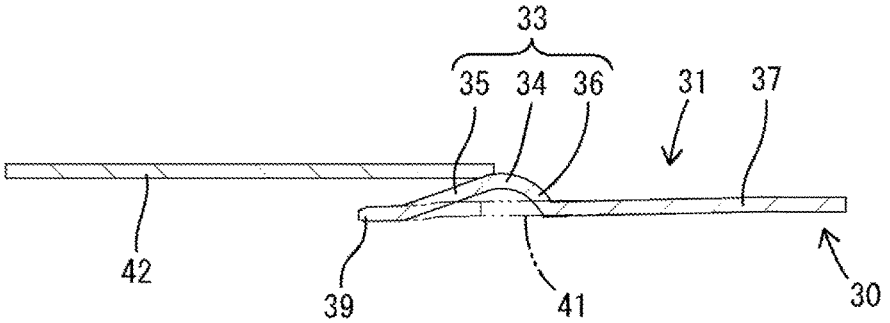
FIG. 10 is a partial enlarged section schematically showing a state where the leading end edge of the mating outer conductor slides in contact with the resilient contact piece in the process of fitting the tubular fitting portion and the mating outer conductor.

By this radially outward pressing force, the bent regions 33 are entirely resiliently displaced radially outwardly as shown in FIG. 10. According to this resilient displacement of the bent regions 33, the interlocking regions 39 are resiliently deformed to be inclined radially outwardly with the rear ends thereof as supporting points and the straight regions 37 are resiliently deformed to be inclined radially outwardly with the rear ends thereof as supporting points.

Figure 11:
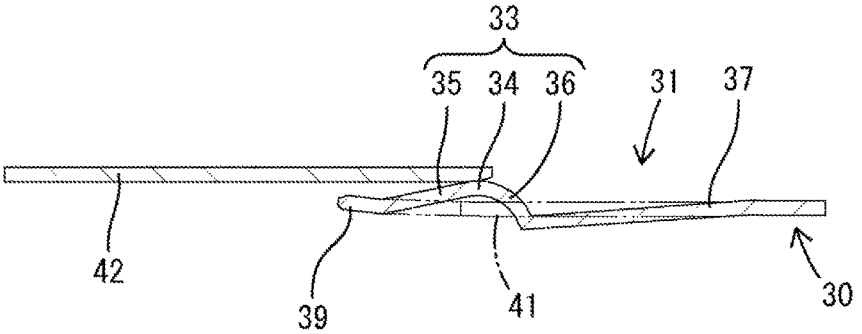
FIG. 11 is a partial enlarged section schematically showing a state where the leading end edge of the mating outer conductor has reached a contact point portion in the process of fitting the tubular fitting portion and the mating outer conductor.
Figure 12:
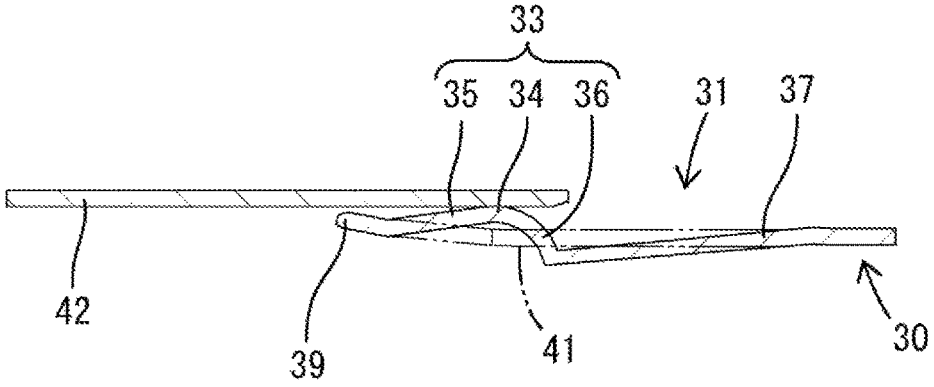
FIG. 12 is a partial enlarged section schematically showing a state where the tubular fitting portion and the mating outer conductor are properly fit.

When the fitting operation of the tubular fitting portion 30 and the mating outer conductor 42 further progresses from the state shown in FIG. 10, the leading end edge of the mating outer conductor 42 reaches the contact point portions 34 as shown in FIG. 11. In a process from the state shown in FIG. 10 to the state shown in FIG. 11, the straight regions 37 are resiliently displaced to be further inclined radially outwardly and the bent regions 33 are further resiliently displaced radially outwardly by the radially outward pressing force acting on the front inclined portions 35 from the mating outer conductor 42.

When the straight regions 37 and the bent regions 33 are resiliently displaced radially outwardly, the rear inclined portions 36 are resiliently displaced rearwardly with the rear ends thereof as supporting points to reduce an angle to the straight regions 37 by the axial pressing force acting on the inner surfaces of the front inclined portions 35 from the mating outer conductor 42. According to this resilient displacement of the rear inclined portions 36, the bent regions 33 are resiliently displaced rearwardly and radially inwardly (upwardly in FIGS. 8 to 12). In this way, the interlocking regions 39 connected to the front ends of the bent regions 33 are resiliently displaced to be inclined radially inwardly with the rear ends 38R of the slits 38 as supporting points by being pulled rearwardly.

In the fitting process of the mating outer conductor 42 and the tubular fitting portion 30 from the state shown in FIG. 11, the straight regions 37 are more resiliently displaced radially outwardly, the rear inclined portions 36 are more resiliently displaced rearwardly and the bent regions 33 are more resiliently displaced rearwardly and radially inwardly by the axial pressing force acting on the contact point portions 34 from the mating outer conductor 42. Accordingly, the interlocking regions 39 are more resiliently displaced radially inwardly.

When the mating outer conductor 42 and the tubular fitting portion 30 (outer conductor terminal 20) are fit, not only the resilient contact portions 31 are resiliently deformed, but also the interlocking regions 39, which are the front end part of the tubular fitting portion 30, are resiliently deformed to interlock with the resilient contact portions 31. Thus, a stress generated in the tubular fitting portion 30 when the mating outer conductor 42 and the outer conductor terminal 20 are fit is distributed to the resilient contact portions 31 and the interlocking regions 39. In this way, a contact pressure between the resilient contact portions 31 and the mating outer conductor 42 is reduced as compared to the case where only the resilient contact portions 31 are resiliently deformed.

As described above, the shield terminal 10 of this embodiment aims to suppress the contact pressure of the resilient contact portions 31 without changing the shape, dimensions and the like of the resilient contact portions 31 when the resilient contact portions 31 of the outer conductor terminal 20 are supported on both ends. As a means for that, the shield terminal 10 includes the inner conductor terminal 11, the first and second dielectrics 12, 13 configured to accommodate the inner conductor terminal 11 and the outer conductor terminal 20 configured to surround the first and second dielectrics 12, 13.

The tubular fitting portion 30 is formed in the front end part of the outer conductor terminal 20 in the axial direction. The tubular fitting portion 30 is formed with the resilient contact portions 31 supported on both ends and having both front and rear ends thereof in the axial direction of the outer conductor terminal 20 integrally connected to the tubular fitting portion 30. Out of the tubular fitting portion 30, the interlocking regions 39 surrounding only the front end parts 31F of the resilient contact portions 31 and connected to the front ends of the resilient contact portions 31 are radially resiliently deflectable with the front end sides thereof as free ends.

When the resilient contact portions 31 are resiliently deformed by being radially pressed, the interlocking regions 39 of the tubular fitting portion 30 connected to the front ends of the resilient contact portions 31 interlock with the resilient contact portions 31 and are radially resiliently deformed. Since stresses generated in the resilient contact portions 31 are alleviated by the resilient deformation of the interlocking regions 39, the contact pressures of the resilient contact portions 31 can be reduced without changing the shape, dimensions and the like of the resilient contact portions 31.

Further, the tubular fitting portion 30 is formed with the non-interlocking regions 40 that are areas not corresponding to the resilient contact portions 31 in the circumferential direction and adjacent to the interlocking regions 39 in the circumferential direction via the slits 38. The front end edges of the interlocking regions 39 and those of the non-interlocking regions 40 are disposed at the same position in the front-rear direction. According to this configuration, if an external matter interferes with the tubular fitting portion 30 from front, an impact of interference is distributed to both the interlocking regions 39 and the non-interlocking regions 40. Thus, improper deformation of the interlocking regions 39 can be avoided.

Further, the resilient contact portion 31 has the bent region 33 composed of the contact point portion 34, the front inclined portion 35 and the rear inclined portion 36. The contact point portion 34 contacts the outer periphery of the mating outer conductor 42 with the tubular fitting portion 30 properly fit to the mating outer conductor 42. The front inclined portion 35 is inclined radially outwardly toward the front from the contact point portion 34, and a leading end part of the mating outer conductor 42 is brought into sliding contact with the front inclined portion 35. The rear inclined portion 36 is inclined radially outwardly toward the rear from the contact point portion 34. The angle of inclination of the rear inclined portion 36 with respect to the fitting direction of the mating outer conductor 42 and the outer conductor terminal 20 (tubular fitting portion 30) is larger than that of the front inclined portion 35 with respect to the fitting direction.

According to this configuration, when the leading end part of the mating outer conductor 42 slides in contact with the front inclined portion 35 and the resilient contact portion 31 is pressed rearwardly, the bent region 33 formed with the front inclined portion 35 and the rear inclined portion 36, out of the resilient contact portion 31, is resiliently deformed radially inwardly with the rear end of the rear inclined portion 36 substantially as a supporting point by that pressing force. According to this resilient deformation of the resilient contact portion 31, the interlocking region 39 is resiliently displaced radially inwardly. When the interlocking region 39 is resiliently displaced radially inwardly, a width of the slit 38 between the interlocking region 39 and the non-interlocking region 40 is narrowed. Thus, a reduction in shielding function due to the presence of the slit 38 can be suppressed.

Further, the rear end 38R of the slit 38 is located before the rear end of the rear inclined portion 36. According to this configuration, a large radially inward resilient displacement amount of the interlocking region 39 can be ensured as compared to the case where the rear end 38R of the slit 38 is located behind the rear end of the rear inclined portion 36.

The present invention is not limited to the above described and illustrated embodiment. For example, the following embodiments are also included in the technical scope of the present invention.

Although the resilient contact portion projects toward the inner peripheral side in the above embodiment, the resilient contact portion may project toward the outer peripheral side.

Although the tubular fitting portion is formed with the non-interlocking regions adjacent to the interlocking regions in the circumferential direction via the slits in the above embodiment, the tubular fitting portion may include only the interlocking regions cantilevered forward without including the non-interlocking regions.

Although the interlocking region is resiliently deformed to displace the front end side thereof radially inwardly in the above embodiment, the interlocking region may be resiliently deformed to displace the front end side thereof radially outwardly.

Although a pair of resilient contact portions are formed side by side in one interlocking region in the above embodiment, only one, three or more resilient contact portions may be formed in one interlocking region.

Although the rear end of the slit is located slightly before the contact point portion of the resilient contact portion in the above embodiment, the rear end of the slit may be positioned behind the contact point portion or may be at the same position as the contact point portion in the front-rear direction.

Although the rear end of the slit is located before the rear end of the rear inclined portion in the above embodiment, the rear end of the slit may be located behind the rear end of the rear inclined portion.

LIST OF REFERENCE SIGNS

10 . . . shield terminal
11 . . . inner conductor terminal
12 . . . first dielectric (dielectric)
13 . . . second dielectric (dielectric)
20 . . . outer conductor terminal
30 . . . tubular fitting
31 . . . resilient contact
31F . . . front end part of resilient contact portion
34 . . . contact
35 . . . front inclined portion
36 . . . rear inclined portion
38 . . . slit
38R . . . rear end of slit
39 . . . interlocking region
40 . . . non-interlocking region
42 . . . mating outer conductor

What is claimed is:

1. A shield terminal, comprising:

an inner conductor terminal;

a dielectric configured to accommodate the inner conductor terminal;

an outer conductor terminal configured to surround the dielectric;

a tubular fitting formed in a front end part of the outer conductor terminal in an axial direction;

a resilient contact having a rear end in the axial direction integrally connected to the tubular fitting; and an interlocking region connected to the front end of the resilient contact and to areas of the tubular fitting offset circumferentially from the resilient contact so that the interlocking region is radially resiliently deflectable with a front end thereof being a free end, wherein the tubular fitting is formed with a non-interlocking region offset from the resilient contact in a circumferential direction and spaced from the interlocking region in the circumferential direction by a slit.

2. The shield terminal of claim 1, wherein the resilient contact includes:

a contact configured to contact an outer periphery of a mating outer conductor with the tubular fitting properly fit to the mating outer conductor;

a front inclined portion inclined radially out toward the front from the contact and configured such that a leading end part of the mating outer conductor is brought into sliding contact therewith; and a rear inclined portion inclined radially outward toward the rear from the contact and having a larger angle of inclination with respect to a fitting direction to the mating outer conductor than the front inclined portion.

3. The shield terminal of claim 2, wherein a rear end of the slit is located before a rear end of the rear inclined portion.

4. An outer conductor terminal of a shield terminal, the outer conductor terminal surrounding a dielectric that has an inner conductor terminal accommodated inside, the outer conductor terminal comprising:

a tubular fitting in a front end part in an axial direction, the tubular fitting;

a resilient contact having a rear end in the axial direction of the outer conductor terminal integrally connected to the tubular fitting; and an interlocking region connected to a front end of the resilient contact and connected to front end areas of the tubular fitting that are circumferentially offset from the resilient contact, the interlocking region being radially resiliently deformable with a front end thereof as a free end, wherein the tubular fitting is formed with a non-interlocking region offset from the resilient contact in a circumferential direction and spaced from the interlocking region in the circumferential direction by a slit.

* * * * *